US006253499B1

(12) United States Patent
Sidy

(10) Patent No.: US 6,253,499 B1
(45) Date of Patent: Jul. 3, 2001

(54) HUMAN HABITAT STRUCTURE FOR PLACEMENT UPON A NON-UNIFORM, NON-LEVEL SITE

(76) Inventor: Victor E. Sidy, 380 Raintree Rd., Sedona, AZ (US) 86351

( * ) Notice: Subject to any disclaimer, the term of this patent is extended or adjusted under 35 U.S.C. 154(b) by 0 days.

(21) Appl. No.: 09/576,377

(22) Filed: May 22, 2000

(51) Int. Cl.[7] ..... E04H 1/00

(52) U.S. Cl. ..... 52/79.1; 52/79.4; 52/126.1; 52/413; 52/169.1; 52/169.4

(58) Field of Search ..... 52/79.1, 79.4, 52/169.4, 413, 747.1, 747.11, 171, 7, 126.1, 91.1, 169.1; 14/71.1

(56) References Cited

U.S. PATENT DOCUMENTS

| | | | | |
|---|---|---|---|---|
| 3,474,582 | | 10/1969 | Wah et al. . | |
| 3,571,993 | | 3/1971 | Potter . | |
| 3,604,166 | | 9/1971 | Ciccarelli et al. . | |
| 3,771,273 | | 11/1973 | Brodie . | |
| 4,050,215 | | 9/1977 | Fisher . | |
| 4,534,141 | | 8/1985 | Fagnoni . | |
| 5,249,397 | * | 10/1993 | Monaco | 52/126.1 |
| 5,913,782 | * | 6/1999 | Monaco et al. | 52/126.1 |

* cited by examiner

*Primary Examiner*—Christopher T. Kent
*Assistant Examiner*—Dennis L. Dorsey
(74) *Attorney, Agent, or Firm*—Jeffrey D. Moy; Jeffrey Weiss; Weiss & Moy, P.C

(57) ABSTRACT

A human habitat structure for placement upon a non-uniform, non-level site. The human habitat structure for placement upon a non-uniform, non-level site comprises: a planer floor member placed upon a non-uniform, non-level, site such that the planer floor member is substantially parallel to and co-planer to an average virtual plane of the non-uniform, non-level, site wherein a horizontal axis of the planer floor member is substantially level; a first side member having a bottom edge coupled to a first edge of the planer floor member, wherein the first side member and the planer floor member have a substantially right angle relationship; a planer roof member located substantially co-planer, parallel to, and above the planer floor member, the planer roof member having a first edge coupled to a second edge of the first side member; a first levelable platform having a first end hingeably coupled to an upper surface of the planer floor member; wherein a horizontal axis of a hinge of the hingeably coupled first end of the first levelable platform is substantially level; and wherein the first levelable platform forms a level plane upon the elevation of a second end.

17 Claims, 3 Drawing Sheets

HUMAN HABITAT STRUCTURE FOR PLACEMENT UPON A NON-UNIFORM, NON-LEVEL SITE

BACKGROUND OF THE INVENTION

1. Field of the Invention

This invention relates to human habitat structures that may be placed at a non-uniform, non-level site, and more specifically, to an inexpensively constructed structure in which the floor, walls and roof are all at substantially right angles to one another, such that when the structure is placed upon the selected site it has an inherently sloped roof for water runoff.

2. Description of the Related Art

Many locations require human habitat structures for temporary, emergency, or merely cost effective shelter purposes. When erecting a shelter to meet these needs at various sites, various factors are important. One factor is the site of the structure. Specifically, is the site level and of uniform grade? A non-uniform, non-level site must first be graded level when constructing traditional structures—an expensive and environmentally intrusive proposition.

Another factor is that when constructing a structure, the roof must be sloped for water runoff. The expense of constructing a structure upon a non-uniform, non-level site in order to have a level floor, while at the same time having a roof that provides for water runoff, is complex and expensive.

Additionally, sites requiring emergency human habitat structures generally do not have generous time allowances available for the grading, construction or installation of structures.

Therefore, a need existed for a human habitat structure that would be inherently adaptable to non-uniform, non-level, site. Another need existed for a human habitat structure that inherently has a sloped roof for water runoff. A further need existed for a human habitat structure that is inexpensive and non-complex to construct.

SUMMARY OF THE INVENTION

It is an object of the present invention to provide for a human habitat structure that would be inherently adaptable to a non-uniform, non-level, site.

It is another object of the present invention to provide a human habitat structure that inherently has a sloped roof for water runoff.

It is a further object of the invention to provide for a human habitat structure that is inexpensive and non-complex to construct.

The foregoing and other objects, features, and advantages of the invention will be apparent from the following, more particular, description of the preferred embodiment of the invention, as illustrated in the accompanying drawings.

BRIEF DESCRIPTION OF THE PREFERRED EMBODIMENTS

According to one aspect of the invention, a human habitat structure for placement upon a non-uniform, non-level site is disclosed. The human habitat structure for placement upon a non-uniform, non-level site comprises: a planer floor member placed upon a non-uniform, non-level, site such that the planer floor member is substantially parallel to and co-planer to an average virtual plane of the non-uniform, non-level, site wherein a horizontal axis of the planer floor member is substantially level; a first side member having a bottom edge coupled to a first edge of the planer floor member, wherein the first side member and the planer floor member have a substantially right angle relationship; a planer roof member located substantially co-planer, parallel to, and above the planer floor member, the planer roof member having a first edge coupled to a second edge of the first side member; a first levelable platform having a first end hingeably coupled to an upper surface of the planer floor member; wherein a horizontal axis of a hinge of the hingeably coupled first end of the first levelable platform is substantially level; and wherein the first levelable platform forms a level plane upon the elevation of a second end.

According to another aspect of the invention, a human habitat structure for placement upon a non-uniform, non-level site is disclosed. The human habitat structure for placement upon a non-uniform, non-level site comprises: a planer floor member placed upon a non-uniform, non-level, site such that the planer floor member is substantially parallel to and co-planer to an average virtual plane of the non-uniform, non-level, site wherein a horizontal axis of the planer floor member is substantially level; a first side member having a bottom edge coupled to a first edge of the planer floor member, wherein the first side member and the planer floor member have a substantially right angle relationship; a planer roof member located substantially co-planer, parallel to, and above the planer floor member, the planer roof member having a first edge coupled to a second edge of the first side member; a first levelable platform having a first end hingeably coupled to an upper surface of the planer floor member, wherein a horizontal axis of a hinge of the hingeably coupled first end of the first levelable platform is substantially level, and wherein the first levelable platform forms a level plane upon the elevation of a second end; and a second levelable platform having a first end hingeably coupled to an upper surface of the planer floor member, wherein a horizontal axis of a hinge of the hingeably coupled first end of the second levelable platform is substantially level, and wherein the second levelable platform forms a level plane upon the elevation of a second end.

DESCRIPTION OF THE PREFERRED EMBODIMENTS

The present invention embodies a concept for a structure that may be erected or placed at a location that has not been previously graded or leveled in preparation for the structure.

The structure of the present invention has many uses. For example, it may serve as an emergency type of structure for fast and inexpensive erection in emergency sites. Additionally, the present invention may serve as a temporary shelter or work space in remote or temporary locations.

The structure of the present invention is based on the following considerations: When building any structure, the roof must be built to have a slope to ensure water runoff. This is one of the most expensive features of any structure in time and material because after a builder expends time and material to ensure a level site and a level underlying structure, the builder must now expend further time and materials to construct a non-level roof to ensure water runoff. The present invention however, is designed for placement upon a non-uniform, non-level site. Thus, the present invention avoids the need to level either the base structure or the underlying building site. Additionally, because the present invention is all right angles, i.e. the roof parallels the floor, and the sides are perpendicular to the floor and the roof, the expense and material of a leveled structure are avoided. Furthermore, because the floor plane parallels the plane of the ground upon which the structure sits, the roof which parallels the floor is inherently sloped for water runoff, again avoiding the additional time and material that would normally be required for a sloped roof.

Referring to FIGS. 1–4, perspective, overhead sectional, elevational sectional views (along line 3—3 of FIG. 2.), and end sectional views (along line 4—4 of FIG. 2) of the present invention, a human habitat structure for placement upon a nonuniform, non-level site are shown (the "habitat 10" hereinafter.) The habitat 10 is generally a rectangular structure having an entrance, or door 18*a*–*b*, and/or window 16*a*–*b* at one or more ends 30*a*–*b*.

The habitat 10 of the present invention may be built in the field of square or rectangular panels, or constructed elsewhere and transported to the desired site as prefabricated members. Further, the materials may be steel, wood, plastics, composites, expanded polystyrene (EPS), etc. so long as the material possess sufficient structural strength for the habitat 10.

Figure 1:
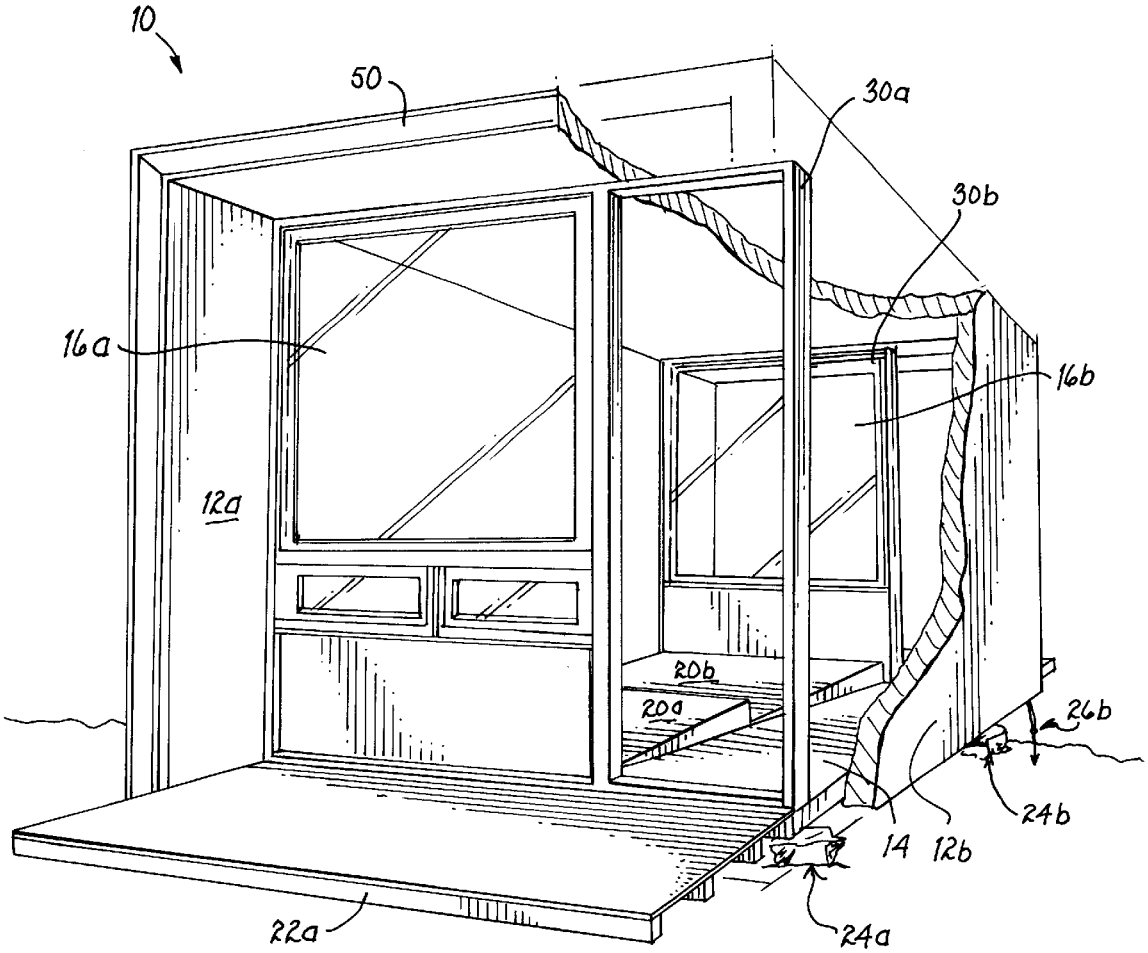
FIG. 1 is a perspective view of the present invention, a human habitat structure for placement upon a non-uniform, non-level site.
Figure 3:
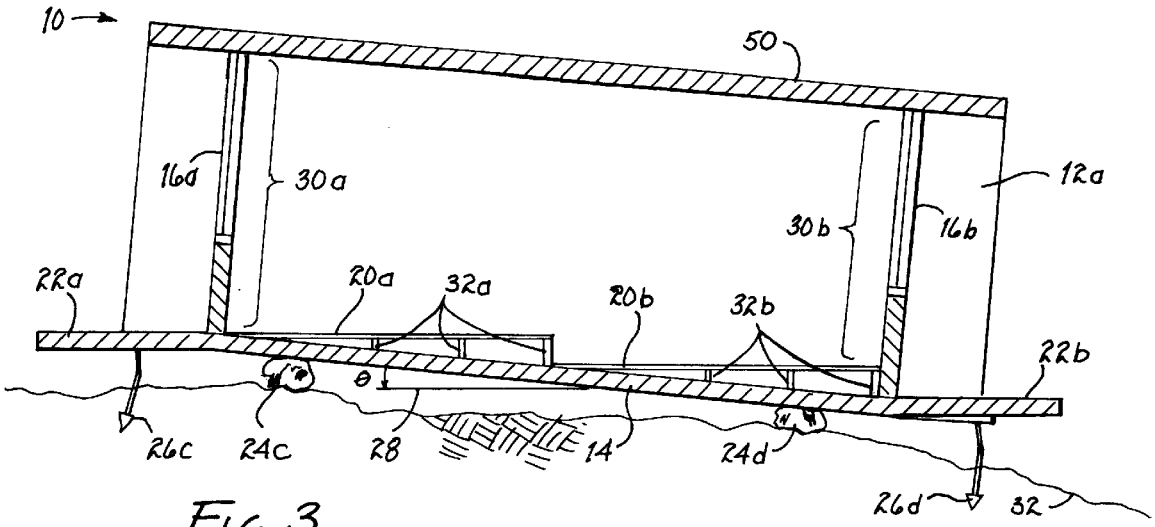
FIG. 3 is an elevational sectional view of the present invention along line 3—3 of FIG. 2.
Figure 4:
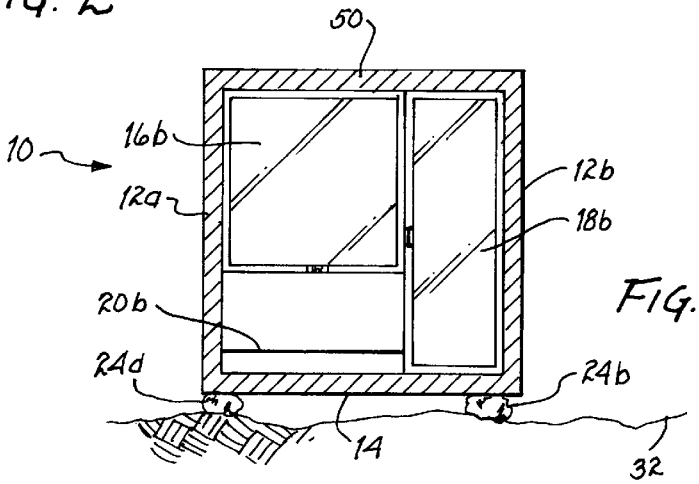
FIG. 4 is an end sectional view of the present invention along line 4—4 of FIG. 2.

A preferred embodiment of the habitat 10 comprises a floor 14 placed upon a non-uniform, non-level site 32 (See FIG. 3 and 4.) As shown in FIG. 3, the site 32 slopes, and a floor 14 placed upon that slope will thus inherently acquire a slope of the same average angle 28 as the site 32. i.e. the floor 14 will have a downward slope from end 30*a* down to end 30*b*.

Referring to FIG. 4, the view perpendicular to the view of FIG. 3 is shown. It should be noted that the habitat 10 is placed upon the site 32 so that an axis of the habit 10 is substantially parallel to the site 32 surface having a substantially level axis at that position i.e. the axis from side 12*a* to side 12*b* is substantially level. Thus—the habitat 10 will also have a level axis running sideways from 12*a*–12*b*. Further—the habitat 10's floor 14 plane will be co-planer with an average virtual plane of the non-uniform, non-level, site 32 with an axis of the floor 14 being substantially level, while a perpendicular axis of the floor 14 follows the slope of the site 32.

The habitat 10 also comprises two sides 12*a*–*b*, coupled to the floor 14, ends 30, and a roof 50. The floor 14, the sides 12, the roof 50, and the ends 30 are all coupled to each other at their respective touching edges at right angles—thus achieving a goal of simple and inexpensive construction. The habitat 10's ends 30*a*–*b* further comprise windows 16*a*–*b* and doors 18*a*–*b* coupled to, or within the ends 30*a*–*b*. The doors 18 and windows 16, as would be appreciated by those skilled in the art, may comprise various quantities, sizes and shapes. Furthermore, an end 30*a*–*b* may alternatively be a substantially solid member without a door 18 or a window 16, or may comprise only a door or only a window. Doors 18 and windows 16 may also be placed in the sides 12. Those skilled in the art will also appreciate that even though an elongated structure is shown herein, the actual dimensions may vary in length, width and height without departing from the spirit or scope of the present invention.

Figure 2:
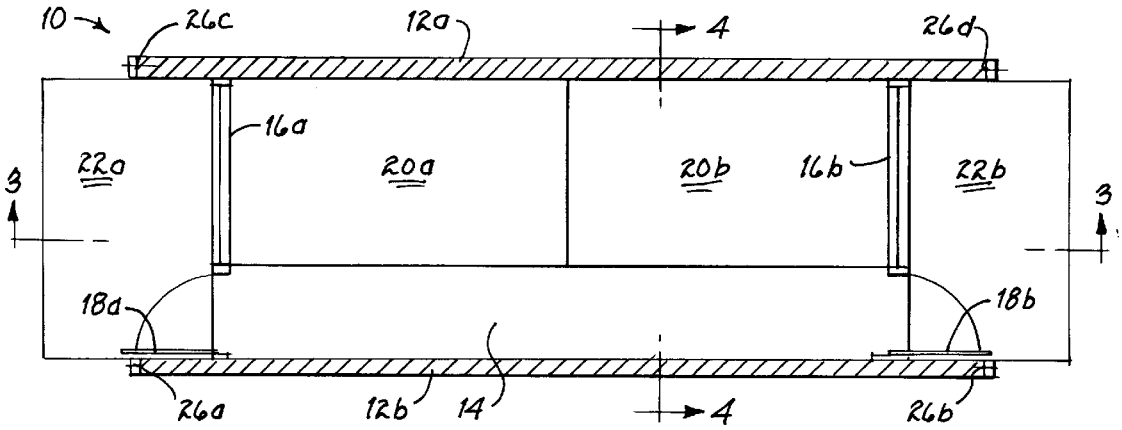
FIG. 2 is an overhead sectional view of the human habitat structure for placement upon a non-uniform, non-level site.

Referring further to FIGS. 2–3, the habitat further comprises porches 22*a*–*b*, each placed respectively at opposing ends of the habitat 10. The porches 22*a*–*b* may be an extension of the floor 14, or as shown, may be separate platforms 22*a*–*b* coupled to the floor 14 and have their coupling angle adjusted in order to achieve a level platform 22*a*–*b* and ease entrance and egress from the habitat 10 by users.

The habitat 10 may either be placed directly on the site 32, or may be placed upon support members 24*a*–*d*. The support members 26*a*–*d* may be transported-in materials such as beams, concrete blocks, etc, or may be local materials such as rocks, timbers, tree stumps, etc. The placement of the support members 24*a*–*d* may aid in ensuring proper drainage beneath the habitat 10 depending on the site 32's environment. The habitat 10 further comprises anchors 26*a*–*d* that are coupled to the habitat 10 and to the site 32 at suitable locations to anchor the habitat 10 to the site 32. The anchors 26*a*–*d* may be comprised of metal, wood, or other suitable materials for securing the habitat 10 to the site 32. The anchors 26*a*–*d* may be hammered, screwed, embedded in concrete, etc. to the site 32.

Referring to FIG. 2, the overhead cutaway view of the habitat 10 is shown. The floor 14 is noted running lengthwise between the doors 18*a*–*b*. The habitat 10 further comprises two platforms 20*a* and *b* coupled within the habitat 10. The platforms 20*a*–*b* are a key feature of the present invention. Referring to FIG. 3, it is seen that the platforms 20*a*–*b* are leveled within the habitat 10. The uphill end of each platform 20*a*–*b* is hingably coupled (not shown herein) to the floor 14 of the habitat 10. The hingable coupling allows the elevation of the downhill end of each platform 20*a*–*b* until the platforms 20*a*–*b* are level. The platform 20*a*–*b* leveling results in the plane of each platform being level along both axis. This feature of the habitat 10 of the present invention thus allows an easy and inexpensive means of providing level surfaces for users while taking advantage of the sloped site 32 for water runoff and reduced construction costs. Each of the platforms 20*a*–*b* once level is supported with bracing 32*a* and 32*b* respectively. As those skilled in the art will appreciate, various means of providing the numbers and placement of the bracing 32*a*–*b* may be utilized without departing from the spirit and scope of the present invention. It should also be noted that although two platforms 20*a*–*b* are shown herein, greater than two platforms may be utilized within the habitat 10 as the size of the habitat 10 is increased, just as for a smaller habitat 10 only a single platform might be utilized. The size of the platforms 20*a*–*b* is of a width that allows the sloping floor 14 to function as a walkway from end 30*a* to end 30*b* while allowing access to the platforms 20*a*—*b*.

The platforms 20*a–b* may further comprise designated use platform inserts that may be placed upon the platforms 20*a–b*, or may also be integral parts of the platforms 20*a–b*. Referring to FIGS. 5–8, embodiments are shown with assorted platform inserts upon the platforms 20*a–b*.

Figure 5:
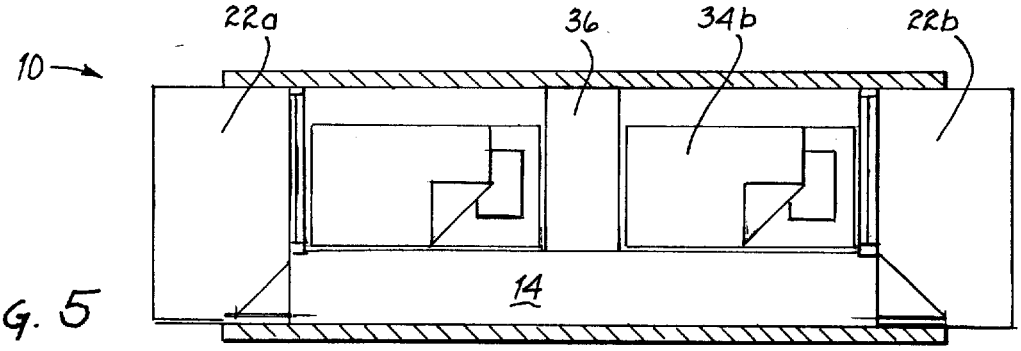
FIG. 5 is an overhead sectional view of the human habitat structure for placement upon a non-uniform, non-level site showing an embodiment with sleeping platforms.

Referring to FIG. 5, two sleeping platforms 34*a* and 34*b* are shown within the habitat 10. The sleeping platforms 34*a–b* further comprise a privacy/shelf/storage divider 36 between the sleeping platforms 34*a–b*.

Figure 6:
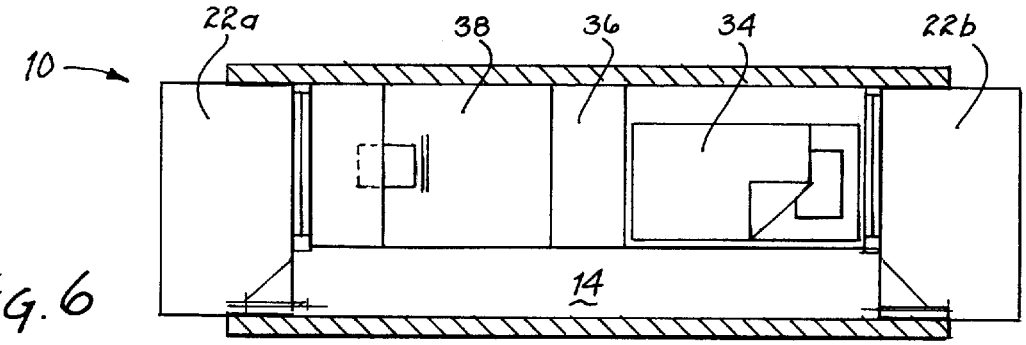
FIG. 6 is an overhead sectional view of the human habitat structure for placement upon a non-uniform, non-level site showing an embodiment with a desk/study/work platform and a sleeping platform.

Referring to FIG. 6, another embodiment of the habitat 10 of the present invention is shown. A desk/work area/workbench platform 38 is shown in place of the sleeping platform 34*a*. Also shown in FIG. 6 is a sleeping platform 34 and a privacy/shelf/storage divider 36 between the sleeping platform 34 and the desk/work area/workbench platform 38.

Figure 7:
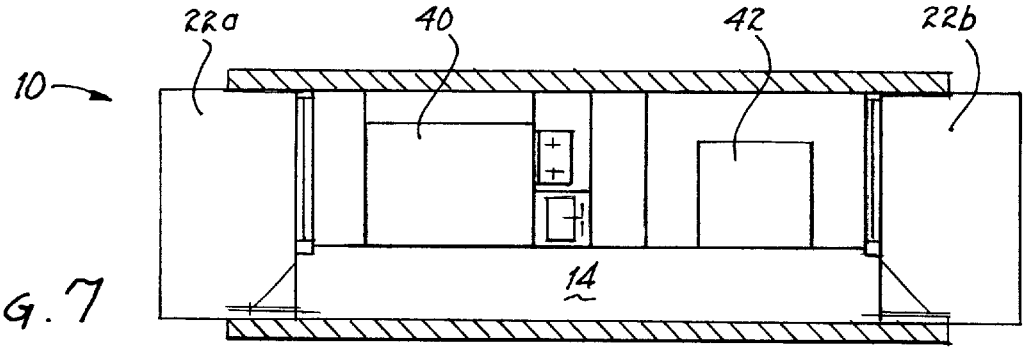
FIG. 7 is an overhead sectional view of the human habitat structure for placement upon a non-uniform, non-level site showing an embodiment with a kitchen platform and a dining area platform.

Referring to FIG. 7, yet another embodiment of the habitat 10 of the present invention is shown. A kitchen area 40 is placed within the habitat 10, and a dining area 42 is shown placed next to the kitchen area 40.

Figure 8:
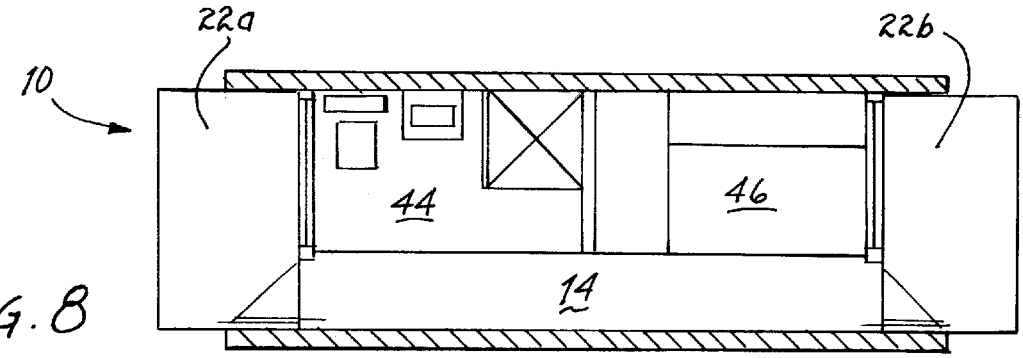
FIG. 8 is an overhead sectional view of the human habitat structure for placement upon a non-uniform, non-level site showing an embodiment with a bathroom platform and a dressing area platform.

Referring to FIG. 8, yet a further embodiment of the habitat 10 of the present invention is shown. A bathroom area 44 comprising standard bathroom components is shown placed within the habitat 10, and a dressing area 46 is shown placed next to the bathroom area 44.

As those skilled in the art will appreciate, a feature of the habitat 10 of the present invention is the ability to mix and match the platform inserts 34–40 as the user desires, as well as to create additional platform inserts not shown herein.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A human habitat structure for placement upon a nonuniform, non-level site, comprising, in combination:

a planer floor member placed upon a non-uniform, non-level, site such that said planer floor member is substantially parallel to and co-planer to an average virtual plane of said non-uniform, non-level, site wherein a horizontal axis of said planer floor member is substantially level;

a first side member having a bottom edge coupled to a first edge of said planer floor member, wherein said first side member and said planer floor member have a substantially right angle relationship;

a planer roof member located substantially co-planer, parallel to, and above said planer floor member, said planer roof member having a first edge coupled to a second edge of said first side member;

a first levelable platform having a first end hingeably coupled to an upper surface of said planer floor member;

wherein a horizontal axis of a hinge of said hingeably coupled first end of said first levelable platform is substantially level; and wherein said first levelable platform forms a level plane upon the elevation of a second end.

2. The human habitat structure of claim 1 further comprising a second side member having a bottom edge coupled to a second edge of said planer floor member, wherein said second side member and said planer floor member thus have a substantially right angle relationship.

3. The human habitat structure of claim 2 further comprising a third side member having a bottom edge coupled to a third edge of said planer floor member, wherein said third side member and said planer floor member thus have a substantially right angle relationship.

4. The human habitat structure of claim 3 further comprising a fourth side member having a bottom edge coupled to a fourth edge of said planer floor member, wherein said fourth side member and said planer floor member thus have a substantially right angle relationship.

5. The human habitat structure of claim 4 wherein said first, second, third and fourth sides in cooperation with said planer floor member and said planer roof member form a substantially box shaped structure having an inherently sloped said planer roof member co-planer to said average virtual plane of said non-uniform, non-level, site.

6. The human habitat structure of claim 5 further comprising a second levelable platform having a first end hingeably coupled to an upper surface of said planer floor member, wherein a horizontal axis of a hinge of said hingeably coupled second end of said second levelable platform is substantially level, and wherein said second levelable platform forms a level plane upon the elevation of a second end.

7. The human habitat structure of claim 6 wherein each of said first and second levelable platforms are adapted to serve individually as a living/working area wherein each of said first and second levelable platforms comprises a platform insert from the class comprised of:

sleeping platforms;

kitchen platforms;

dining area platforms;

desk/work platforms;

bathroom area platforms; and dressing area platforms.

8. The human habitat structure of claim 5 further comprising a second levelable platform having a first end hingeably coupled to an upper surface of said planer floor member, wherein a horizontal axis of a hinge of said hingeably coupled second end of said second levelable platform is substantially level, and wherein said second levelable platform forms a level plane upon the elevation of a second end.

9. The human habitat structure of claim 8 further comprising:

a second side member having a bottom edge coupled to a second edge of said planer floor member, wherein said second side member and said planer floor member thus have a substantially right angle relationship;

a third side member having a bottom edge coupled to a third edge of said planer floor member, wherein said third side member and said planer floor member thus have a substantially right angle relationship; and a fourth side member having a bottom edge coupled to a fourth edge of said planer floor member, wherein said fourth side member and said planer floor member thus have a substantially right angle relationship.

10. The human habitat structure of claim 9 wherein said first, second, third and fourth sides in cooperation with said planer floor member and said planer roof member form a substantially box shaped structure having an inherently sloped said planer roof member co-planer to said average virtual plane of said non-uniform, non-level, site.

11. The human habitat structure of claim 10 wherein each of said first and second levelable platforms are adapted to serve individually as a living/working area wherein each of said first and second levelable platforms comprises a platform insert from the class comprised of:

sleeping platforms;

kitchen platforms;

dining area platforms;

desk/work platforms;

bathroom area platforms; and dressing area platforms.

12. A human habitat structure for placement upon a nonuniform, non-level site, comprising, in combination:

a planer floor member placed upon a non-uniform, non-level, site such that said planer floor member is substantially parallel to and co-planer to an average virtual plane of said non-uniform, non-level, site wherein a horizontal axis of said planer floor member is substantially level;

a first side member having a bottom edge coupled to a first edge of said planer floor member, wherein said first side member and said planer floor member have a substantially right angle relationship;

a planer roof member located substantially co-planer, parallel to, and above said planer floor member, said planer roof member having a first edge coupled to a second edge of said first side member;

a first levelable platform having a first end hingeably coupled to an upper surface of said planer floor member, wherein a horizontal axis of a hinge of said hingeably coupled first end of said first levelable platform is substantially level, and wherein said first levelable platform forms a level plane upon the elevation of a second end; and a second levelable platform having a first end hingeably coupled to an upper surface of said planer floor member, wherein a horizontal axis of a hinge of said hingeably coupled first end of said second levelable platform is substantially level, and wherein said second levelable platform forms a level plane upon the elevation of a second end.

13. The human habitat structure of claim 12 further comprising a second side member having a bottom edge coupled to a second edge of said planer floor member, wherein said second side member and said planer floor member thus have a substantially right angle relationship.

14. The human habitat structure of claim 13 further comprising a third side member having a bottom edge coupled to a third edge of said planer floor member, wherein said third side member and said planer floor member thus have a substantially right angle relationship.

15. The human habitat structure of claim 14 further comprising a fourth side member having a bottom edge coupled to a fourth edge of said planer floor member, wherein said fourth side member and said planer floor member thus have a substantially right angle relationship.

16. The human habitat structure of claim 15 wherein said first, second, third and fourth sides in cooperation with said planer floor member and said planer roof member form a substantially box shaped structure having an inherently sloped said planer roof member co-planer to said average virtual plane of said non-uniform, non-level, site.

17. The human habitat structure of claim 16 wherein each of said first and second levelable platforms are adapted to serve individually as a living/working area wherein each of said first and second levelable platforms comprises a platform insert from the class comprised of:

sleeping platforms;

kitchen platforms;

dining area platforms;

desk/work platforms;

bathroom area platforms; and dressing area platforms.

* * * * *